US008781712B2

(12) United States Patent
Ikeda et al.

(10) Patent No.: US 8,781,712 B2
(45) Date of Patent: Jul. 15, 2014

(54) ENGINE CONTROL SYSTEM WITH ALGORITHM FOR ACTUATOR CONTROL

(75) Inventors: Sumitaka Ikeda, Anjo (JP); Koji Ishizuka, Chita-gun (JP); Kazuhiro Higuchi, Ichinomiya (JP); Yuuki Nakatsuji, Kariya (JP)

(73) Assignee: Denso Corporation, Kariya (JP)

( * ) Notice: Subject to any disclaimer, the term of this patent is extended or adjusted under 35 U.S.C. 154(b) by 224 days.

(21) Appl. No.: 13/419,485

(22) Filed: Mar. 14, 2012

(65) Prior Publication Data

US 2012/0239270 A1 Sep. 20, 2012

(30) Foreign Application Priority Data

Mar. 14, 2011 (JP) ..... 2011-055646

(51) Int. Cl.
*F02D 41/26* (2006.01)
*F02D 41/14* (2006.01)

(52) U.S. Cl.
CPC ..... *F02D 41/14* (2013.01); *F02D 41/1479* (2013.01)
USPC ..... 701/104; 701/106

(58) Field of Classification Search
CPC . F02D 41/14; F02D 41/1404; F02D 41/1405; F02D 41/1479; F02D 2200/00
USPC ..... 701/103, 104, 106; 123/90.11, 472, 123/406.12, 399
See application file for complete search history.

(56) References Cited

U.S. PATENT DOCUMENTS 7,107,142 B2 9/2006 Harada et al.
8,370,065 B2 * 2/2013 Takashima et al. ..... 701/480
8,401,762 B2 * 3/2013 Asano et al. ..... 701/102
2004/0117105 A1 6/2004 Harada et al.
2008/0228383 A1 9/2008 Nakagawa et al.
2011/0106398 A1 * 5/2011 Ikeda et al. ..... 701/102
2011/0106400 A1 5/2011 Takashima et al.
2011/0106408 A1 * 5/2011 Morimoto et al. ..... 701/103

FOREIGN PATENT DOCUMENTS

JP 2004-124935 4/2004
JP 2007-077935 3/2007
JP 2008-223643 9/2008
JP 2010-203343 9/2010
JP 2011-094585 5/2011

OTHER PUBLICATIONS

Office Action (2 pages) dated Jan. 16, 2013 issued in corresponding Japanese Application No. 2011-055646 and English translation (2 pages).

* cited by examiner

*Primary Examiner* — Hai Huynh
(74) *Attorney, Agent, or Firm* — Nixon & Vanderhye PC

(57) ABSTRACT

An engine control apparatus works to determine a target value of each of performance parameters associated with different types of performances of a combustion engine based on operating conditions of the combustion engine, determine target values of combustion parameters associated with combustion states of fuel in the combustion engine based on the target values of the performance parameters using first correlation data representing correlations between the performance parameters and the combustion parameters, and calculate command values of controlled parameters for actuators as a function of the target values of the combustion parameters. When actual values of the performance parameters are in coincidence with the target values, the system changes or corrects the target value of a selected one of the performance parameters so as to enhance the level of a corresponding one of the performances of the engine based on the other performance parameters.

8 Claims, 9 Drawing Sheets

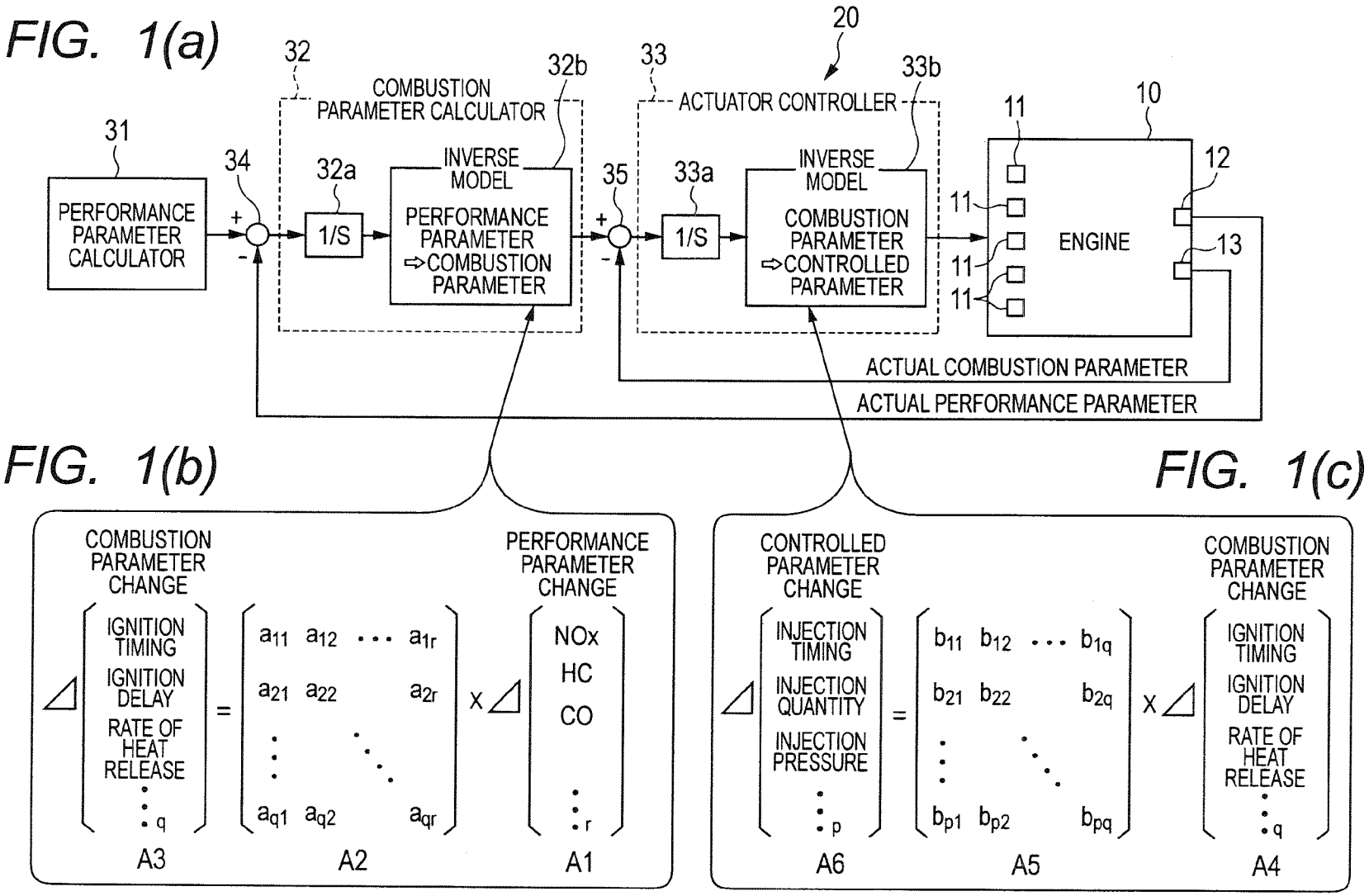
FIG. 1(a)
PERFORMANCE PARAMETER CALCULATOR
31
34
32
COMBUSTION PARAMETER CALCULATOR
32a
1/S
32b
INVERSE MODEL
PERFORMANCE PARAMETER ⇨COMBUSTION PARAMETER
35
33
ACTUATOR CONTROLLER
33a
1/S
33b
INVERSE MODEL
COMBUSTION PARAMETER ⇨CONTROLLED PARAMETER
20
10
ENGINE
11
12
13
ACTUAL COMBUSTION PARAMETER
ACTUAL PERFORMANCE PARAMETER
FIG. 1(b)
COMBUSTION PARAMETER CHANGE
IGNITION TIMING
IGNITION DELAY
RATE OF HEAT RELEASE
A3
A2
PERFORMANCE PARAMETER CHANGE
NOx
HC
CO
A1
FIG. 1(c)
CONTROLLED PARAMETER CHANGE
INJECTION TIMING
INJECTION QUANTITY
INJECTION PRESSURE
A6
A5
COMBUSTION PARAMETER CHANGE
IGNITION TIMING
IGNITION DELAY
RATE OF HEAT RELEASE
A4

| | A IGNITION TIMING | B | C |
|---|---|---|---|
| INJECTION QUANTITY | | | |
| INJECTION TIMING | | | |
| EGR AMOUNT | | | |

| | NOx | CO | FUEL CONSUMPTION |
|---|---|---|---|
| A IGNITION TIMING | | | |
| B | | | |
| C | | | |

ENGINE CONTROL SYSTEM WITH ALGORITHM FOR ACTUATOR CONTROL

CROSS REFERENCE TO RELATED DOCUMENT

The present application claims the benefit of priority of Japanese Patent Application No. 2011-55646 filed on Mar. 14, 2011, the disclosure of which is incorporated herein by reference.

BACKGROUND

1. Technical Field

This disclosure relates generally to an engine control system which may be employed in automotive vehicles and is designed to use an algorithm to control operations of actuators such as a fuel injector and an EGR (Exhaust Gas Recirculation) valve to regulate a combustion state of fuel in an internal combustion engine and also to control the performance of the engine.

2. Background Art

Engine control systems are known which determine controlled variables or parameters such as the quantity of fuel to be injected into an engine (which will also be referred to as an injection quantity), the injection timing, the amount of a portion of exhaust gas to be returned back to the inlet of the engine (which will also be referred to as an EGR amount below), the boost pressure, the amount of intake air, the ignition timing, and an open/close timing of intake and exhaust valves to yield desired engine performance. As parameters related to the engine performance (which will also be referred to below as performance parameters), there are the amount of exhaust emissions, for example, NOx or CO, the torque outputted by the engine, and the specific fuel consumption (or fuel efficiency).

Most of the engine control systems are equipped with control maps which store optimum values of the controlled parameters, for example, the quantity of fuel to be injected into the engine, etc. for achieving the desired engine performance. The control maps are usually made by adaptability tests performed by an engine manufacturer. The engine control systems work to calculate a target value (which will also be referred to as a command) of each of the controlled parameters needed to meet the desired engine performance using a corresponding one of the control maps and output the command to a corresponding actuator to bring the value of the performance parameter into agreement with its target value.

When the commands of the controlled parameters are set up independently of each other, it may result in interference between the different types of controlled parameters in that when one of the performance parameters reaches its target value, another performance parameter deviates from its target value, while when the another performance parameter is brought to the target value, the previously mentioned one of the performance parameters deviates from the target one. It is, therefore, very difficult to bring the different types of performance parameters into agreement with target values simultaneously.

Japanese Patent First Publication No. 2008-223643 teaches an engine control system which calculates a target value of each combustion parameter (e.g., a target pressure in a cylinder of the engine) based on an operating condition of the engine and brings an actual value of the combustion parameter, as measured by a sensor, into agreement with the target value in a feedback mode. Japanese Patent First Publication No. 2007-77935 teaches a feedback mode using a predicted value, as calculated by a simulation model.

The above prior art systems are designed to determine a target value of each of the combustion parameters as functions of the respective performance parameters such as the amount of exhaust emissions, the torque outputted by the engine, and the specific fuel consumption. Therefore, when an actual value of one of the combustion parameters is brought into agreement with the target value in the feedback mode, a corresponding one of the performance parameters will be adjusted to its target value, but however, it may result in a deviation of another of the performance parameters from the target value thereof. It is, thus, difficult to bring the different types of performance parameters into agreement with target values simultaneously.

SUMMARY

It is therefore an object of the invention to provide an engine control apparatus constructed to minimize a deterioration of performance of an engine which arises from the interactive interference between performance parameters to yield desired operating conditions of the engine.

According to one aspect of an embodiment, there is provided an engine control apparatus which may be employed in automotive vehicles. The engine control apparatus comprises: (a) a target performance parameter determining circuit which determines a target value of each of a plurality of performance parameters associated with different types of performances of a combustion engine based on operating conditions of the combustion engine; (b) a target combustion parameter determining circuit which determines target values of a plurality of combustion parameters associated with combustion states of fuel in the combustion engine based on the target values of the performance parameters using first correlation data representing correlations between the performance parameters and the combustion parameters; and (c) a control command calculator which calculates command values as a function of the target values of the combustion parameters, as determined by the target combustion parameter determining circuit, the command values being provided to actuators which work to control the combustion states of the fuel in the combustion engine for achieving desired levels of the performances of the combustion engine, the command values representing controlled parameters associated with operations of the actuators. When actual values of the performance parameters are in coincidence with the target values, as determined by the target performance parameter determining circuit, the target performance parameter determining circuit serves as a target operating circuit which selects at least one of the performance parameters as a target to be corrected and corrects the target value of the selected one of the performance parameters so as to enhance the level of a corresponding one of the performances of the engine based on non-targets that are others of the performance parameters.

The first correlation data defines the correlations between the different types of performance parameters such as the amount of NOx, the amount of PM (Particulate Matter), torque output of the engine, and a consumption of fuel in the engine and the different types of combustion parameters such as the ignition timing, the ignition lag, and the heat release rate, but does not define a one-to-one correspondence between each of the performance parameters and one of the combustion parameters. For instance, the first correlation data does not define only a relation between the fuel consumption and the heat release rate, but defines combinations of the combustion parameters such as the ignition timing, the ignition lag, and the heat release rate required for achieving respective target values of all the performance parameters such as the amount of NOx, the amount of PM, and the fuel consumption simultaneously.

Therefore, unlike the prior art system which separately calculates target values of the combustion parameters each corresponding to one of the performance parameters, the engine control apparatus serves to avoid the mutual interference between the different types of performance parameters which usually contributes to the deterioration of controllability of the engine control apparatus. In other words, the use of the first correlation data results in improved controllability in bringing values of the plurality of performance parameters into agreement with target values simultaneously. The first correlation data may be expressed in an arithmetic expression defined by an inverse model of an engine system in which the performance parameters and the combustion parameters have correlations to each other.

When all the performance parameters are in coincidence with target values thereof, one or some of them may also be adjusted or corrected to better values. For example, when the amount of NOx and the fuel consumption are both controlled to be coincident with a target value A and a target value B, respectively, the fuel consumption may be allowed to be changed further by a decrement a while keeping the amount of NOx at the target value A. The engine control apparatus is designed to operate or change the target value of any of the performance parameters in such a situation.

Specifically, in the condition where actual values of the performance parameters are controlled to be coincident with target values thereof, as determined based on the operating conditions of the engine, the engine control apparatus selects at least one of the performance parameters as a target to be changed and change the target value of the selected one of the performance parameters so as to enhance the level of a corresponding one of the performances of the engine based on information about the other performance parameters. The use of the first correlation data enables the engine control apparatus to figure out how the combustion parameters will change when the selected one of the performance parameters is changed or corrected and also figure out how the other performance parameters, as selected as non-targets not to be corrected, change based on the changes in the combustion parameters. The engine control apparatus is, therefore, operable to optimize the selected one of the performance parameters while monitoring how the performance parameters will change. The combustion states of fuel in the engine (i.e., the combustion parameters) has given correlations to the controlled parameters for the actuators, thus enabling the engine control apparatus to know the changes in the performance parameters and then control the operations of the actuators. This minimizes the deterioration of controllability of the engine control apparatus resulting from the interference between the performance parameters and enhances the performance of the engine.

The performance parameters may include at least two of physical quantities associated with exhaust emissions (e.g., the amount of NOx, the amount of PM (Particulate Matter), the amount of CO, and the amount of HC), torque outputted from the engine, the speed of the engine, a consumption of fuel in the engine (or a travel distance per consumed volume of fuel or a consumed volume per running time of the engine), and combustion noise emitted from the engine (or engine vibrations or combustion or exhaust noise). Some of such types of performance parameters will interfere with each other. For instance, when the torque output from the engine is increase, it will results in a decrease in consumption of fuel in the engine. The engine control apparatus is designed to aim at avoiding such parameter interference.

In the preferred mode of the embodiment, the target operating circuit may calculate changes in the others of the performance parameters, selected as the non-targets, which are expected to arise from changing of the target value of the one of the performance parameters, selected as the target, and correct or change the target value of the selected one of the performance parameter based on the calculated changes. Specifically, the correction of the selected one of the performance parameters will result in changes in the other performance parameters. It is preferable to change the target value of the selected one of the performance parameters so as to keep the values of the other performance parameters from changing excessively over the target values.

The target operating circuit may work to calculate allowable variable ranges in which actual values of the combustion parameters are allowed to be changed, calculate changes in the performance parameters corresponding to the allowable variable ranges of the combustion parameters using the first correlation data, and determine the change in the selected one of the performance parameters as a manipulative variable by which the target value of the selected one of the performance parameters is to be corrected when the changes in the other performance parameters lie in permissible ranges. The first correlation data may be expressed in an arithmetic expression defined by a forward model of an engine system in which the performance parameters and the combustion parameters have correlations to each other.

The use of the first correlation data facilitates figuring out the correlations between the performance parameters and the combustion parameters, thus resulting in ease of calculating the changes in the plurality of performance parameters which correspond to the variable ranges of the combustion parameters. The changes in the performance parameters may be different from each other. However, the change in the selected one of the performance parameters is set to the amount by which the target value of the selected one of the performance parameters is allowed to be changed or corrected only when the changes in the other performance parameters lie within the permissible ranges, thus ensuring the stability in bringing the actual values of the other performance parameters into agreement with the target values even when the target value of the selected one of the performance parameters is corrected.

The target operating circuit may determine the manipulative variable as a maximum manipulative variable and correct the target value of the selected one of the performance parameters gradually within the maximum manipulative variable.

Specifically, the change in the selected one of the performance parameters, as calculated using the first correlation data and the allowable variable ranges of the combustion parameters, is determined as a maximum possible amount by which the target value of the selected one of the performance parameters is allowed to be corrected in the condition in which the changes in the other performance parameters are within the permissible ranges. The engine control apparatus corrects the target value of the selected one of the performance parameters gradually or stepwise within the maximum possible amount, thus ensuring the stability in correcting the target value while keeping the combustion states of fuel in the engine from changing undesirably.

The target operating circuit may determine whether a change in at least one of the combustion parameters which arises from correction of the target value of the selected one of the performance parameters is greater than a given value or not. When the change in the at least one of the combustion parameters is determined to be greater than the given value, the target operating circuit stops correcting the target value of the selected one of the performance parameters.

The changing of any of the performance parameters will result in changes in the plurality of combustion parameters. The changes in the combustion parameters represent changes in combustion states of fuel in the engine. The engine control apparatus is, thus, operable to control the correction of the selected one of the performance parameters while monitoring the changes in combustion states of fuel in the engine.

The target operating circuit may alternatively determine whether changes in selected some or all of the combustion parameters which are predicated to arise from the correction of the target value of the selected one of the performance parameters are less than or equal to given respective values or not or whether the greatest one of the changes in all of the combustion parameters is less than or equal to a given value or not.

The target operating circuit may alternatively be designed to calculate changes in the combustion parameters which arise from correction of the target value of the selected one of the performance parameters and determine whether one of the changes in the combustion parameters which is the strongest in correlation to the selected one of the performance parameter is greater than a given value or not. When the change in the one of the combustion parameters is determined to be greater than the given value, the target operating circuit may stop operating or correcting the target value of the selected one of the performance parameters.

Specifically, the correlations of performance parameters to the combustion parameters are different in strength from each other. The correlations of the selected one of the performance parameters to the combustion parameters are also different in strength from each other. The determination of whether the selected one of the performance parameters is to be changed or not may be made correctly by monitoring the changes in the combustion parameters in terms of the differences in strength of the correlations. Specifically, the engine control apparatus monitors a change in one of the combustion parameters which is the strongest in correlation to the selected one of the performance parameters, thus controlling the correction of the target value of the selected one of the performance parameters with high sensitivity to the change in the one of the combustion parameters.

The target operating circuit may also work to calculate allowable variable ranges in which actual values of the controlled parameters are allowed to be changed. The target operating circuit may determine the allowable variable ranges of the combustion parameters which correspond to the allowable variable ranges of the controlled parameters using second correlation data defining correlations between the combustion parameters and the controlled parameters. The second correlation data may be expressed in an arithmetic expression defined by a forward model of an engine system in which the combustion parameters and the controlled parameters have correlations to each other.

The use of the second correlation data defining the correlations between the combustion parameters and the controlled parameters facilitates ease of calculating the allowable variable ranges of the combustion parameters as a function of the allowable variable ranges of the controlled parameters. The allowable variable ranges of the combustion parameters may be derived simultaneously, thus resulting in improved efficiency in determining the allowable variable ranges of the combustion parameters for correcting the target value of the performance parameter.

The target operating circuit may select a specific fuel consumption in the combustion engine as the selected one of the performance parameters and also determine amounts of exhaust emissions from the combustion engine as the other performance parameters selected to be the non-targets. The target operating circuit may correct the target value of the specific fuel consumption based on the amounts of exhaust emissions. This optimizes the consumption of fuel in the engine in real time without deteriorating the exhaust emissions such as NOx, CO, and HC.

The control command calculator may use second correlation data which defines correlations between the combustion parameters and the controlled parameters to determine the command values for the controlled parameters as a function of the target values of the combustion parameters.

The second correlation data defines the correlations between the combustion parameters such as the ignition timing, the ignition lag, and the heat release rate and the controlled parameters such as the quantity of fuel to be injected into the engine, the EGR amount, and the supercharging pressure, but does not define a one-to-one correspondence between each of the combustion parameters and one of the controlled parameters. For instance, the second correlation data does not define only a relation between the ignition timing and the quantity of fuel to be injected, but defines but defines combinations of the controlled parameters required for achieving respective target values of all the combustion parameters simultaneously.

Therefore, unlike the prior art system which separately calculates the command values of the controlled parameters each corresponding to one of the combustion parameters, the engine control apparatus serves to avoid the mutual interference between the different types of controlled parameters which usually contributes to the deterioration of controllability of the engine control apparatus. In other words, the use of the second correlation data results in improved controllability in bringing values of the plurality of combustion parameters into agreement with target values simultaneously. The second correlation data may be expressed in an arithmetic expression defined by an inverse model of an engine system in which the combustion parameters and the controlled parameters have correlations to each other.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 1(*a*) is a block diagram which shows an engine control system according to the first embodiment;

FIG. 1(*b*) is an illustration which represents a determinant used as a combustion parameter arithmetic expression;

FIG. 1(*c*) is an illustration which represents a determinant used as a controlled parameter arithmetic expression;

FIG. 3(*b*) is an illustration which exemplifies the correlation, as defined by the controlled parameter arithmetic expression of FIG. 3(*a*);

FIG. 3(*c*) is an illustration which exemplifies the correlation, as defined by the combustion parameter arithmetic expression of FIG. 3(*a*);

FIG. 6(*b*) is an illustration which represents a determinant used as a correlation arithmetic expression used in the target fuel consumption controller of FIG. 5;

DESCRIPTION OF THE PREFERRED EMBODIMENTS

Figure 2:
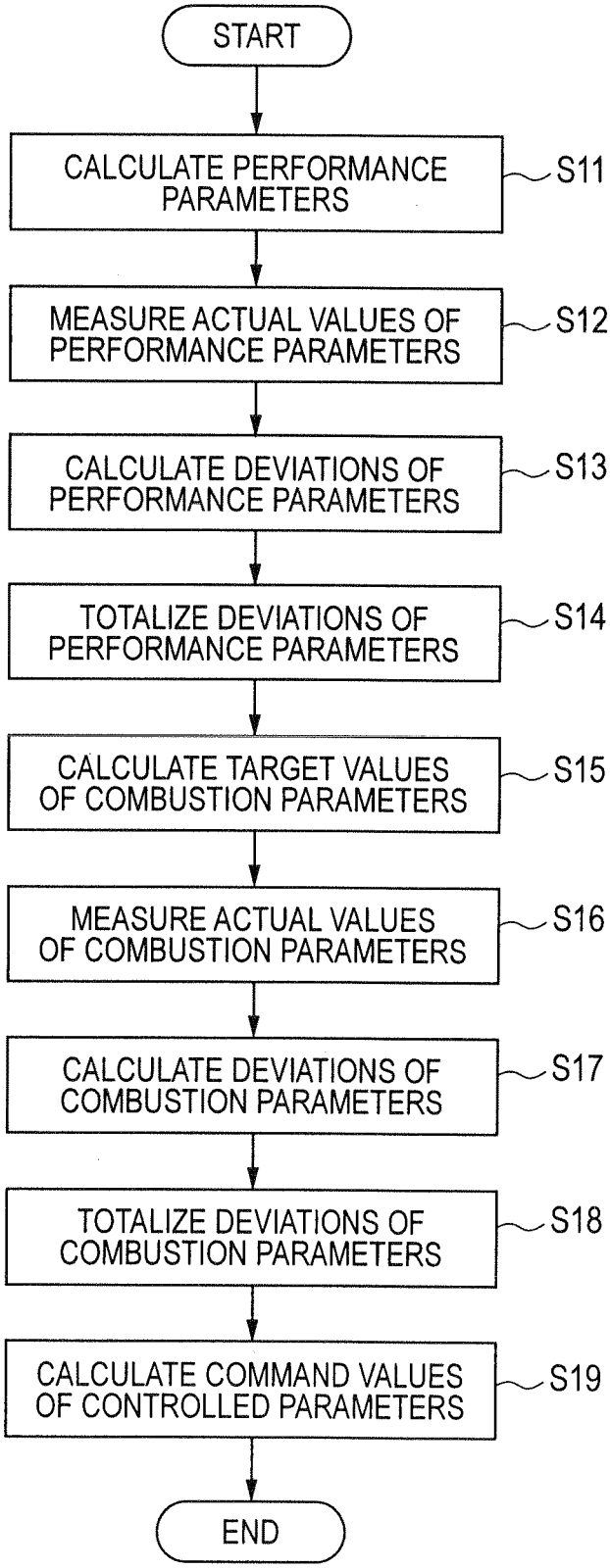
FIG. 2 is a flowchart of an actuator control program to be executed by the engine control system of FIG. 1(*a*)

Referring to the drawings, wherein like reference numbers refer to like parts in several views, particularly to FIG. 1(*a*), there is shown an engine control system according to the first embodiment which is designed to control an operation of an internal combustion engine 10 for automotive vehicles. The following discussion will refer to, as an example, a self-ignition diesel engine in which fuel is sprayed into four cylinders #1 to #4 at a high pressure.

FIG. 1(*a*) is a block diagram of the engine control system implemented by an electronic control unit (ECU) 20 which works to control operations of a plurality of actuators 11 to regulate fuel combustion states of the engine 10 for yielding desired output characteristics or performance of the engine 10.

The actuators 11 installed in a fuel system are, for example, fuel injectors which spray fuel into the engine 10 and a high-pressure pump which controls the pressure of fuel to be fed to the fuel injectors. The ECU 20 works to calculate a command value representing a target controlled variable, i.e., a target amount of fuel to be sucked and discharged by the high-pressure pump and output it in the form of a command signal to the high-pressure pump to control the pressure of fuel to be sprayed into the engine 10. The ECU 20 also determines command values representing target controlled variables, i.e., a target quantity of fuel to be sprayed from each of the fuel injectors (i.e., an injection duration), a target injection timing at which each of the fuel injectors is to start to spray the fuel, and the number of times each of the fuel injectors is to spray the fuel in each engine operating cycle (i.e., a four-stroke cycle) including intake or induction, compression, combustion, and exhaust and output them in the form of command signals to the fuel injectors.

The actuators 11 installed in an air intake system are, for example, an EGR (Exhaust Gas Recirculation) valve which controls the amount of a portion of exhaust gas emitted from the engine 10 to be returned back to an inlet port of the engine 10 (which will also be referred to as an EGR amount below), a variably-controlled supercharger which regulates the supercharging pressure variably, a throttle valve which controls the quantity of fresh air to be inducted into the cylinder of the engine 10, and a valve control mechanism which sets open and close timings of intake and exhaust valves of the engine 10 and regulates the amount of lift of the take and exhaust valves. The ECU 20 works to calculate command values representing target controlled variables, i.e., target values of the EGR amount, the supercharging pressure, the quantity of fresh air, the open and close timings, and the amount of lift of the intake and exhaust valves and output them in the form of command signals to the EGR valve, the variably-controlled supercharger, the throttle valve, and the valve control mechanism, respectively. In the way as described above, the ECU 20 controls the operations of the actuators 11 to achieve the target controlled variables, thereby controlling the combustion states in the engine 10 to achieve required performance of the engine 10.

The combustion states of the engine 10, as referred to above, are defined by a plurality of types of combustion parameters. For example, the combustion parameters are the ignition timing, the ignition lag (also called ignition delay) that is a time interval between start of spraying of the fuel from the fuel injector and the ignition of the sprayed fuel), and the heat release rate. Such combustion parameters are physical quantities which are usually measured by, for example, a cylinder pressure sensor which measures the pressure in the cylinder of the engine 10.

The performance of the engine 10 is expressed by a plurality of types of performance parameters that are ones of, for example, a physical quantity associated with exhaust emissions (e.g., the amount of NOx, the amount of PM (Particulate Matter), and the amount of CO or HC), a physical quantity associated with torque outputted from the engine 10 (e.g., the torque of an output shaft of the engine 10) and the speed of the engine 10, a physical quantity associated with a fuel consumption in the engine 10 (e.g., a travel distance per consumed volume of fuel or a consumed volume per running time of the engine 10, as measured through mode running tests), and a physical quantity associated with combustion noise (e.g., engine vibrations or combustion or exhaust noise).

The ECU 20 is equipped with a typical microcomputer including a CPU performing operations on given tasks, a RAM serving as a main memory storing therein data produced during the operations of the CPU or results of the operations of the CPU, a ROM serving as a program memory, an EEPROM storing data therein, and a backup RAM to which electric power is supplied at all the time from a backup power supply such as a storage battery mounted in the vehicle even after a main electric power source of the ECU 20 is turned off.

The engine 10 has installed therein the sensors 12 and 13 which provide outputs to the ECU 20. The sensors 12 are engine output sensors working to measure the performance parameters actually. For example, the engine output sensors 12 are implemented by a gas sensor which measures the concentration of a component (e.g., NOx) of exhaust emissions from the engine 10, a torque sensor which measures the torque outputted by the engine 10, and a noise sensor which measures the magnitude of noise arising from the combustion of fuel in the engine 10. The actual values of the performance parameters may alternatively be calculated or estimated using algorithmic models without use of the sensors 12.

The sensors 13 are combustion state sensors to determine the above described combustion parameters actually. For example, the sensors 13 are, as described above, implemented by the cylinder pressure sensor which measures the pressure in the combustion chamber (i.e., the cylinder) of the engine 10 and an ion sensor which measures the quantity of ion, as produced by the burning of fuel in the engine 10. For example, the ECU 20 calculates a change in pressure in the combustion chamber of the engine 10, as measured by the cylinder pressure sensor 13, to determine both the ignition timing and the ignition delay. The actual values of the combustion parameters may alternatively be calculated or estimated using an algorithmic model without use of the sensors 13.

The ECU 20 works as an engine controller equipped with a performance parameter calculator 31, a combustion parameter calculator 32, an actuator controller 33, a performance parameter deviation calculator 34, and a combustion parameter deviation calculator 35. The performance parameter calculator 31 serves as a target performance parameter determining circuit to determine target values of the performance parameters. The combustion parameter calculator 32 serves as a target combustion parameter determining circuit to calculate target values of the combustion parameters required to bring actual values of the performance parameters into agreement with the target values thereof. The actuator controller 33 serves as a control command calculator to produce command values for controlling the operations (i.e., the controlled variables) of the actuators 11 to achieve target combustion states of the engine 10 for yielding required levels of performances of the engine 10. The controlled variables will also be referred to below as controlled parameters. The performance parameter deviation calculator 34 serves as an engine performance feedback circuit to calculate a difference or deviation of an actual value of each of the performance parameters (i.e., the outputs from the engine output sensors 12) from a target value thereof. The combustion parameter deviation calculator 35 serves as a combustion parameter feedback circuit to calculate a difference or deviation of an actual value of each of the combustion parameters (i.e., the outputs from the combustion state sensors 13) from a target value thereof. These functional blocks 31 to 35 are implemented logically in the microcomputer of the ECU 20.

Specifically, the combustion parameter calculator 32 has an integrator 32*a* and a combustion parameter arithmetic expression 32*b*. The integrator 32*a* works to sum or totalize each of the performance parameter deviations, as calculated by the performance parameter deviation calculator 34. The combustion parameter arithmetic expression 32*b* is stored in a memory such as the ROM of the ECU 20.

The combustion parameter arithmetic expression 32*b* is made to define correlations between the different types of performance parameters associated with different types of performances of the engine 10 and the different types of combustion parameters associated with different types of combustion states of fuel in the engine 10. Specifically, the combustion parameter arithmetic expression 32*b* is provided by an engine performance-to-combustion parameter model, as illustrated in FIG. 1(*a*), or a determinant, as illustrated in FIG. 1(*b*), and to mathematically express relations of the combustion states of the engine 10 (i.e., the combustion parameters) to the performance states of the engine 10 (i.e., the performance parameters). In other words, the combustion parameter arithmetic expression 32*b* produces values of the combustion states of the engine 10 needed to meet the required values of the performance parameters. Target values of the combustion parameters (or amounts by which the target values, as derived in the previous control cycle, are required to be changed) are obtained by substituting target values of the performance parameters (or deviations of the actual values from the required values) into the combustion parameter arithmetic expression 32*b*.

In practice, the integrator 32*a* totalizes the deviations of the actual values of the performance parameters, respectively and substitutes them into the combustion parameter arithmetic expression 32*b* to minimize the possibility that the actual values of the performance parameters will deviate from the target values thereof constantly. When the total value of the deviation becomes zero (0), a corresponding value, as calculated by the combustion parameter arithmetic expression 32*b*, will be zero. The target values of the combustion parameters are, therefore, so set as to keep the combustion states of the engine 10 as they are.

The actuator controller 33 includes an integrator 33*a* and a controlled parameter arithmetic expression 33*b*. The integrator 33*a* works to sum or totalize the deviation of the actual value of each of the combustion parameters from the target value thereof, as derived by the combustion parameter deviation calculator 35. The controlled parameter arithmetic expression 33*b* is stored in a memory (i.e., a storage device) such as the ROM of the ECU 20.

The controlled parameter arithmetic expression 33*b* is made to define correlations between the different types of combustion parameters and the different types of controlled variables (i.e., controlled parameters). The controlled parameter arithmetic expression 33*b* is provided by a combustion parameter-to-controlled variable model, as illustrated in FIG. 1(*a*), or a determinant, as illustrated in FIG. 1(*c*) and mathematically express values of the controlled parameters corresponding to desired combustion states of the engine 10. In other words, the controlled parameter arithmetic expression 33*b* provides a combination of values of the controlled parameters needed to place the engine 10 in target combustion states. The command values for the controlled parameters (or amounts by which the command values are to be changed) are, therefore, obtained by substituting target values of the combustion parameters (or amounts by which the target values are to be changed) into the combustion parameter arithmetic expression 33*b*.

The combustion parameter deviation calculator 35 of the structure of FIG. 1(*a*) substitutes the combustion parameter deviations (i.e., the amounts by which the target values are required to be changed) into the controlled parameter arithmetic expression 33*b* to determine amounts by which the command values, as derived in the previous control cycle, are needed to be changed in this control cycle in order to derive amounts by which the controlled parameters provided in the previous control cycle are required to be changed in this control cycle.

Specifically, the integrator 33*a* integrates or totalizes the deviations of the actual values of the combustion parameters from the target values thereof, as derived by the combustion parameter deviation calculator 35 and substitutes them into the controlled parameter arithmetic expression 33*b*, respectively, to minimize the possibility that the actual values of the combustion parameters will deviate from the target values thereof constantly. When the total value of each of the deviations becomes zero (0), a corresponding value, as calculated by the controlled parameter arithmetic expression 33*b*, will be zero. The command value for each of the controlled parameters is, therefore, so set as to keep the latest value of the controlled parameter as it is.

How to calculate the command values to be outputted to the actuators 11 to achieve desired values of the controlled parameters thereof will be described below with reference to a flowchart of an actuator control program, as illustrated in FIG. 2. This program is to be executed by the microcomputer of the ECU 20 at a regular interval (e.g., an operation cycle of the CPU or a cycle equivalent to a given crank angle of the engine 10).

After entering the program, the routine proceeds to step S11 wherein target values of the respective performance parameters are calculated based on operating conditions of the engine 10 such as the speed of the engine 10 and the position of the accelerator pedal of the vehicle (i.e., a driver's effort on the accelerator pedal). This operation is made by the performance parameter calculator 31. For example, the ECU 20 calculates the target values using a map which is made by the adaptability tests and stores therein optimum values of the performance parameters in relation to speeds of the engine 10 and positions of the accelerator pedal.

The routine proceeds to step S12 wherein actual values of the respective performance parameters are measured from outputs of the engine output sensors 12. The ECU 20 may alternatively be designed to estimate or calculate the current performance parameters through arithmetic models and determine them as the above actual values without use of the engine output sensors 12. Such estimation may be made only on some of the performance parameters.

The routine proceeds to step S13 wherein the operation of the performance parameter deviation calculator 34 is executed. Specifically, deviations of the actual values of the performance parameters measured in step S12 from the target values thereof derived in step S11 are determined. Such deviations will also be referred to as performance parameter deviations below.

The routine proceeds to step S14 wherein the operation of the integrator 32*a* is executed. Specifically, a total value x(i) of each of the performance parameter deviations, as derived in step S13, is determined. More specifically, the sum of each of the total values x(i−1), as derived one program execution cycle earlier, and a corresponding one of the performance parameter deviations, as derived in this program execution cycle, is calculated as the total value x(i).

The routine proceeds to step S15 wherein the target values of the combustion parameters are calculated. Specifically, the total values x(i), as derived in step S14, are substituted into the combustion parameter arithmetic expression 32*b*. Solutions of the combustion parameter arithmetic expression 32*b* are determined as amounts by which the current or latest values of the combustion parameters are required to be changed. For instance, the combustion parameter arithmetic expression 32*b*, as illustrated in FIG. 1(*b*), is so designed that the product of an r-order column vector A1 of variables representing the performance parameter deviations and a matrix A2 made up of q-by-r elements $a_{11}$ to $a_{rq}$ is defined as a q-order column vector A3 of variables representing amount by which the combustion parameters are to be changed. The total values x(i) of the deviations, as derived in step S14, are substituted into the variables of the column vector A1 to derive solutions of the respective variables (i.e., entries) of the column vector A3. The solutions are determined as amounts by which the latest values of the combustion parameters are needed to be changed to achieve target values thereof derived in this program execution cycle (which will also be referred to as combustion parameter changes below). The ECU 20 also determines reference values of the combustion parameters through maps or mathematical formulas in terms of operating conditions of the engine 10 such as the speed of or load on the engine 10, adds the combustion parameter changes to the reference values, and defines such sums as target values of the combustion parameters (i.e., target value of combustion parameter=reference value+amount by which the latest value of combustion parameter is to be changed).

The routine proceeds to step S16 wherein outputs of the combustion state sensors 13 are monitored to derive actual values of the combustion parameters. The ECU 20 may alternatively calculate or estimate current values of the combustion parameters through arithmetic models and determine them as the above actual values without use of the combustion state sensors 13. Such estimation may be made only on some of the combustion parameters.

The routine proceeds to step S17 wherein the operation of the combustion parameter deviation calculator 35 is performed. Specifically, a deviation of each of the target values of the combustion parameters, as derived in step S15, from a corresponding one of the actual values of the combustion parameters, as derived in step S16, (which will also be referred to as a combustion parameter deviation below) is calculated.

The routine proceeds to step S18 wherein the operation of the integrator 33*a* is performed. Specifically, a total value y(i) of each of the combustion parameter deviations, as derived in step S17, is determined. More specifically, the sum of the total value y(i−1), as derived one program execution cycle earlier, and the combustion parameter deviation, as derived in this program execution cycle, is calculated as the total value y(i).

The routine proceeds to step S19 wherein a command value of each of the controlled parameters (i.e., the controlled variables) is determined. Specifically, the total values y(i) of the combustion parameter deviations, as derived in step S18, are substituted into the controlled parameter arithmetic expression 33*b*. Solutions of the controlled parameter arithmetic expression 33*b* are determined as amounts by which the latest command values for the all types of controlled parameters are needed to be changed or regulated. For instance, the controlled parameter arithmetic expression 33*b*, as illustrated in FIG. 1(*c*), is so designed that the product of an q-order column vector A3 of variables representing the combustion parameter deviations and a matrix A4 made up of p-by-q elements $b_{11}$ to $b_{pq}$ is defined as a p-order column vector A5 of variables representing amount by which the controlled parameters are to be changed. The total values y(i) of the deviations, as derived in step S18, are substituted into the variables of the column vector A4 to derive solutions of the respective variables (i.e., entries) of the column vector A6. The solutions are determined as amounts by which the latest values of the controlled parameters are to be changed to achieve target values thereof (i.e., target command values) derived in this program execution cycle (which will also be referred to as controlled parameter changes below). The ECU 20 also determines reference values of the controlled parameters through maps or mathematical formulas in terms of operating conditions of the engine 10 such as the speed of or load on the engine 10, adds the controlled parameter changes to the reference values, and defines such sums as target values (i.e., command values) of the controlled parameters (i.e., target value of controlled parameter=reference value+amount by which the latest value of controlled parameter is to be changed). The command values are actuator controlled parameters which are to be outputted in the form of command signals to the actuators 11.

Examples of the correlations between the performance parameters and the combustion parameters and between the combustion parameters and the controlled parameters, as defined by the combustion parameter arithmetic expression 32*b* and the controlled parameter arithmetic expression 33*b*, will be described below with reference to FIGS. 3(*a*) to 3(*c*).

Figures 3A, 3B, 3C:
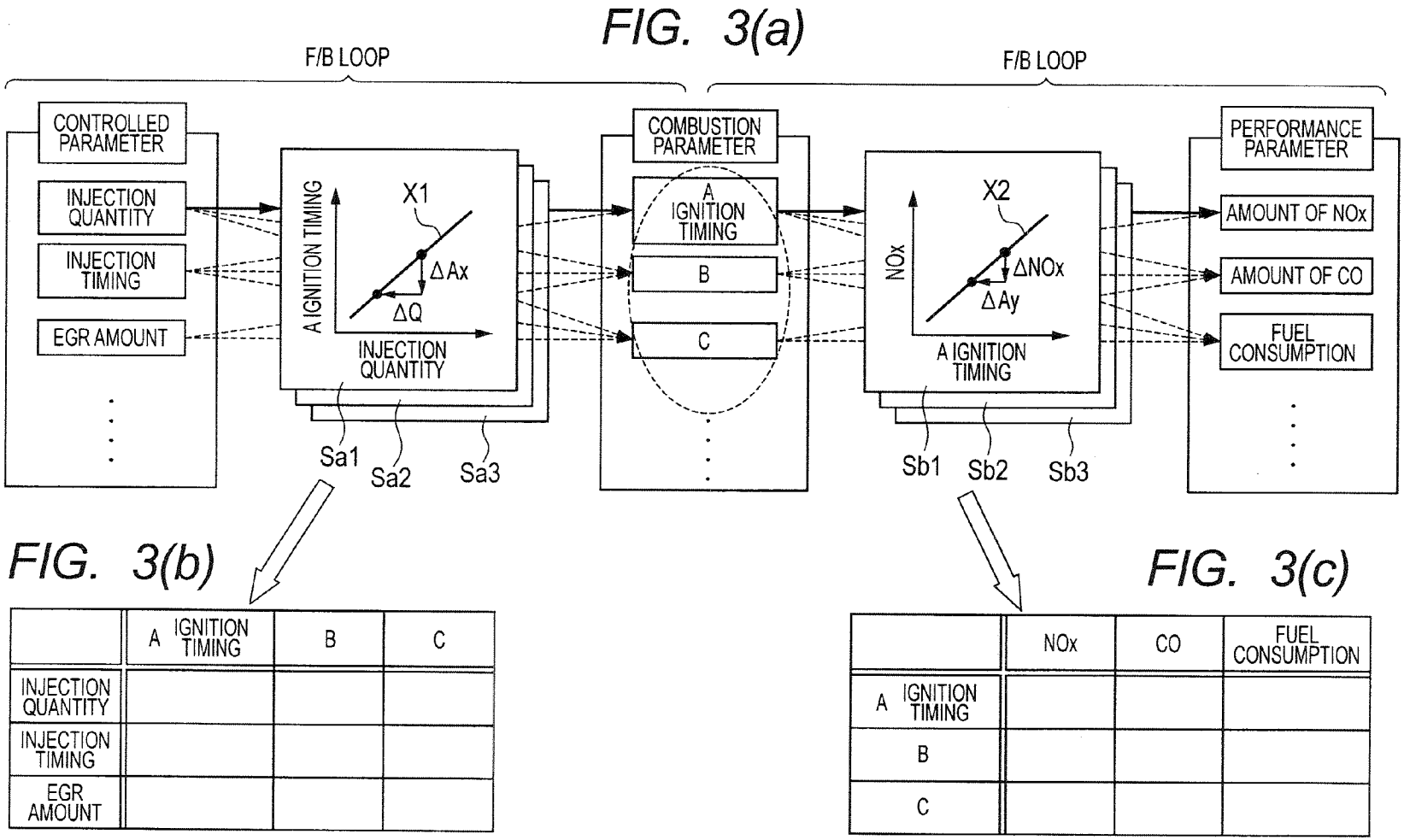
FIG. 3(*a*) is an explanatory view which illustrates correlations, as defined by the combustion parameter arithmetic expression and the controlled parameters arithmetic expression in FIGS. 1(*a*) to 1(*c*)

FIG. 3(*a*) illustrates the above correlations schematically. The injection quantity, the injection duration, and the EGR amount are defined as the controlled parameters (i.e., controlled variables) of the actuators 11. The amount of NOx, the amount of CO, and the fuel consumption are defined as the performance parameters. "A", "B", and "C" represent the different types of combustion parameters, respectively. For instance, "A" indicates the ignition timing in the engine 10.

In the example of FIG. 3(*a*), reference number Sa1 denotes a regression line X1 which represents a correlation between the injection quantity and the combustion parameter A. The regression line X1 is set up by, for example, the multiple regression analysis. Similarly, reference number Sa2 denotes a regression line which represents a correlation between the injection quantity and the combustion parameter B. Reference number Sa3 denotes a regression line which represents a correlation between the injection quantity and the combustion parameter C. Specifically, the correlation, as illustrated in FIG. 3(*b*), between each of the injection quantity, the injection timing, and the EGR amount and one of the combustion parameters A, B, and C is defined by the regression line through the model or the determinant, as described above. Therefore, when combinations of values of the injection quantity, the injection timing, and the EGR amount are specified, corresponding combinations of values of the combustion parameters A, B, and C are obtained. In other words, relations of the controlled parameters to the combustion states of the engine 10 (i.e., the combustion parameters) are defined. The controlled parameter arithmetic expression 33*b* is, as can be seen in FIG. 1(*a*), defined by a model inverse of that in FIG. 3(*a*).

In FIG. 3(*a*), reference number Sb1 denotes a regression line X2 which represents a correlation between the combustion parameter A and the amount of NOx. The regression line X2 is set up by, for example, multiple regression analysis. Similarly, reference number Sb2 denotes a regression line which represents a correlation between the combustion parameter A and the amount of CO. Reference number Sb3 denotes a regression line which represents a correlation between the combustion parameter A and the fuel consumption. Specifically, the correlation, as illustrated in FIG. 3(*c*), between each of the combustion parameters A, B, and C and one of the amount of NOx, the amount of CO, and the fuel consumption is defined by the regression line through the model or the determinant, as described above. Therefore, when combinations of the combustion parameters A, B, and C are specified, corresponding combinations of the amount of NOx, the amount of CO, and the fuel consumption are obtained. In other words, relations of the combustion states of the engine 10 (i.e., the combustion parameters) to the performance states of the engine 10 (i.e., the performance parameters) are defined. The combustion parameter arithmetic expression 32*b* is, as can be seen in FIG. 1(*a*), defined by a model inverse of that in FIG. 3(*a*).

For example, when the target value of the ignition timing A remains unchanged, but the actual value thereof has changed, this difference (i.e., the combustion parameter deviation) is given by the combustion parameter deviation calculator 35. The actuator controller 33 substitutes such a combustion parameter deviation into the model, as indicated in FIG. 3(*b*), or the determinant to derive amounts (i.e., correction values) by which the current values of the injection quantity, the injection timing, and the EGR amount are to be changed or corrected to bring the actual value of the ignition timing A into agreement with the target value thereof.

Taking as an example the deviation ΔA of the ignition timing A (i.e., a difference between the actual value and the target value of the ignition timing A) and a change ΔQ of the injection quantity (i.e., the amount by which the injection quantity is to be changed), the actuator controller 33 derives the change ΔQ of the injection quantity which corresponds to the deviation ΔA in the ignition timing A based on the regression line X1 in FIG. 3(*a*). The controlled parameter arithmetic expression 33*b* in FIG. 3(*b*) defines a plurality of combinations of the combustion parameters and the controlled parameters, so that when only one of the combustion parameters has changed from the target value, all the controlled parameters are corrected simultaneously.

Similarly, when the target value of the amount of NOx is not identical with the actual value thereof has changed, this difference (i.e., the performance parameter deviation) is derived by the performance parameter deviation calculator 34. Such an performance parameter deviation is substituted into the model, as indicated in FIG. 3(*c*), or the determinant to derive amounts (i.e., correction values) by which the current values of the combustion parameters A, B, and C are to be changed or corrected to bring the actual value of the amount of NOx into agreement with the target value thereof.

Taking as an example of the correlation between the performance parameter and the combustion parameter, a target change ΔAy of the ignition timing A (i.e., the amount by which the ignition timing is to be changed) and the deviation ΔNOx of the amount of NOx, the combustion parameter calculator 32 works to derive the target change ΔAy of the ignition timing A which corresponds to the deviation ΔNOx from the regression line X2 in FIG. 3(*a*). The combustion parameter arithmetic expression 32*b* in FIG. 3(*c*) defines a plurality of combinations of the performance parameters and the combustion parameters, so that when only one of the performance parameters has changed from the target value thereof, the target values of all the combustion parameters are changed or corrected simultaneously.

The combustion parameter arithmetic expression 32*b*, as described already, defines the combinations of the performance parameters and the combustion parameters, thus enabling changes in the respective performance parameters in response to a change in one of the combustion parameters to be figured out. For instance, when actual values of the amount of NOx and the amount of PM deviate from target values thereof, respectively, as demonstrated in FIG. 4, such deviations are eliminated by changing the latest value of the ignition timing A1 (i.e., the value, as derived one program execution cycle earlier) to the value A2. Even if the value of the ignition timing A needed to bring the amount of NOx and the amount of PM just into agreement with the target values thereof is not found, optimum values which bring both the amount of NOx and the amount of PM as closer to the target values, respectively, as possible may be derived by the combustion parameter arithmetic expression 32*b*.

Figure 4:
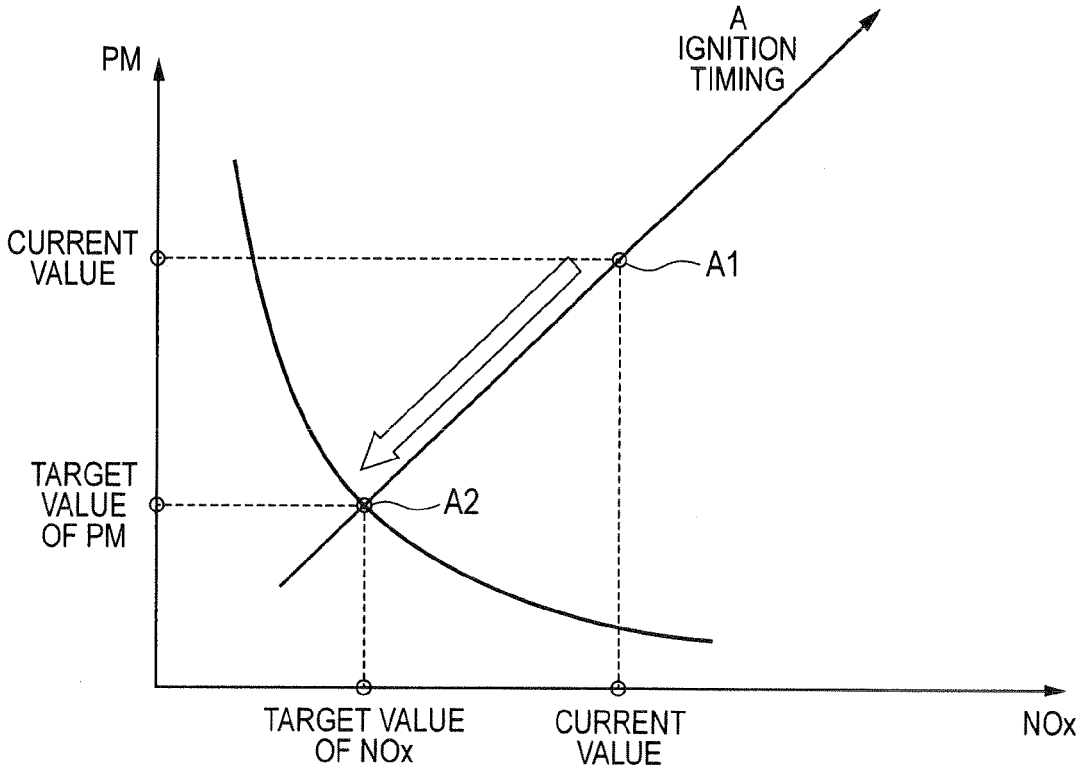
FIG. 4 is an explanatory view which represents effects of a combustion parameter on performance parameters.

FIG. 4 is a schematic view which demonstrates the correction of only the ignition timing A for the sake of convenience, but however, the combustion parameter arithmetic expression 32*b* is, as described above, provided to define a given number of all possible combinations of the different types of performance parameters and the different types of combustion parameters, thus causing the target values of the combustion parameters to be corrected simultaneously in response to one or some of the deviations of the performance parameters.

Like the combustion parameter arithmetic expression 32*b*, the controlled parameter arithmetic expression 33*b* is prepared to define a given number or all possible combinations of the different types of combustion parameters and the different types of controlled parameters, thus causing the command values for the controlled parameters to be corrected simultaneously in response to one or some of the deviations of the combustion parameters.

An example of the operation of the engine control system in the condition where the temperature of coolant for the engine 10 (i.e. one of ambient conditions) changes during the steady state operation of the engine 10 will be described below. For instance, a rise in temperature of the engine coolant will cause the combustion states of the engine 10 to change even when the command values of the controlled parameters are kept unchanged or the performance parameters to change even when the combustion states of the engine 10 are kept unchanged.

The performance parameter deviation calculator 34 then calculates the performance parameter deviations. The engine control system changes the current values of the combustion parameters in the feedback mode so as to minimize or eliminate the performance parameter deviations, as derived by the performance parameter deviation calculator 34. Specifically, the combustion parameter arithmetic expression 32*b* produce target values of the plurality of combustion parameters to minimize the performance parameter deviations simultaneously. The engine control system then sets the controlled parameters so as to eliminate the combustion parameter deviations, as derived by the combustion parameter deviation calculator 35, in the feedback mode. The controlled parameter arithmetic expression 33*b* works to control operations of the actuators 11 simultaneously in a coordinated way to minimize the combustion parameter deviations as a whole, thereby yielding desired engine performance at all the time.

When all the performance parameters are in coincidence with target values thereof, one or some of them may also be adjusted or corrected to better values. The engine control system of this embodiment is designed to select at least one of the performance parameters in the feedback mode where actual values of all the performance parameters are brought into agreement with target values thereof and further improve the target value of the selected one of the performance parameters based on information about the other performance parameters.

An example where one of the performance parameters which is a selected target to be improved further is a fuel consumption (or a specific fuel consumption) in the engine 10, and the other performance parameters which are non-targets are the amount of NOx, HC, and CO of exhaust emissions of the engine 10 will be described below.

Figure 5:
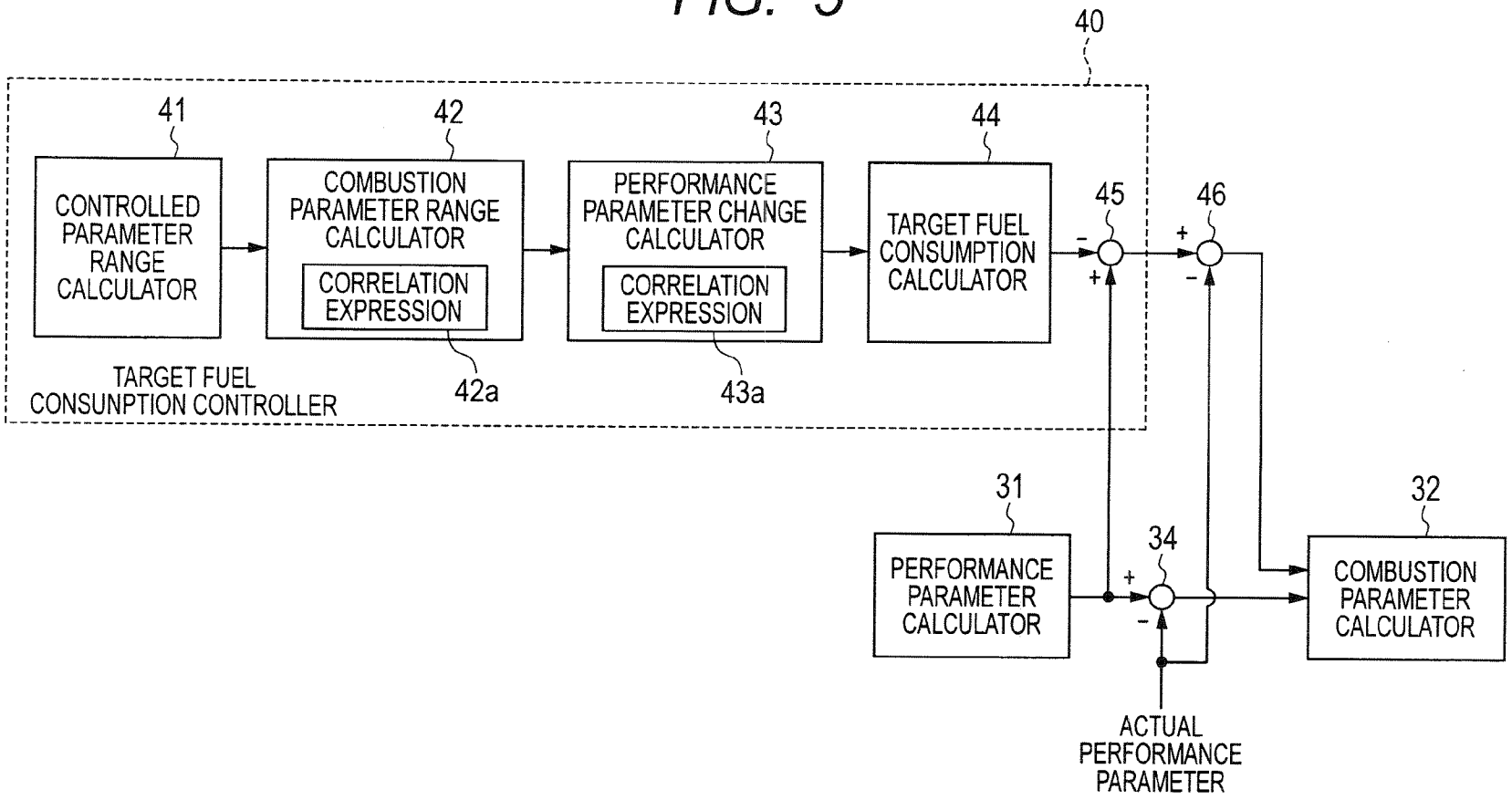
FIG. 5 is a block diagram which illustrates a structure of a target fuel consumption controller installed in the engine control system of FIG. 1.

FIG. 5 illustrates a target fuel consumption controller 40 installed in the engine control system of FIG. 1. The target fuel consumption controller 40 is disposed between the performance parameter calculator 31 and the combustion parameter calculator 32 and works as a target operating circuit along with the performance parameter calculator 31. The target fuel consumption controller 40 may be installed in the performance parameter calculator 31. The target fuel consumption controller 40 is, like in the functional blocks 31 to 35 of FIG. 1(*a*), implemented logically by the microcomputer of the ECU 20.

The target fuel consumption controller 40 serves as a target operating circuit and consists of a controlled parameter range calculator 41, a combustion parameter range calculator 42, a performance parameter change calculator 43, a target fuel consumption calculator 44, and a target updating circuit 45.

The controlled parameter range calculator 41 calculates variable ranges where current values of the controlled parameters are allowed to be changed, respectively. Specifically, the controlled parameter range calculator 41 determines a difference between the current value of each of the controlled parameters and a limit (i.e., a guard value) thereof, as derived based on instantaneous operating conditions of the engine 10, as the variable range.

Figure 6A:
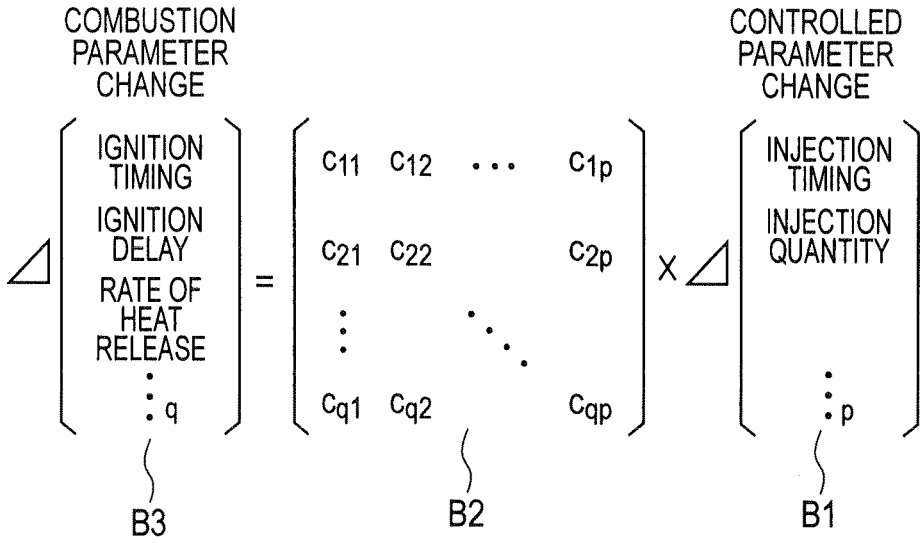
FIG. 6(*a*) is an illustration which represents a determinant used as a correlation arithmetic expression used in the target fuel consumption controller of FIG. 5.
Figure 6B:
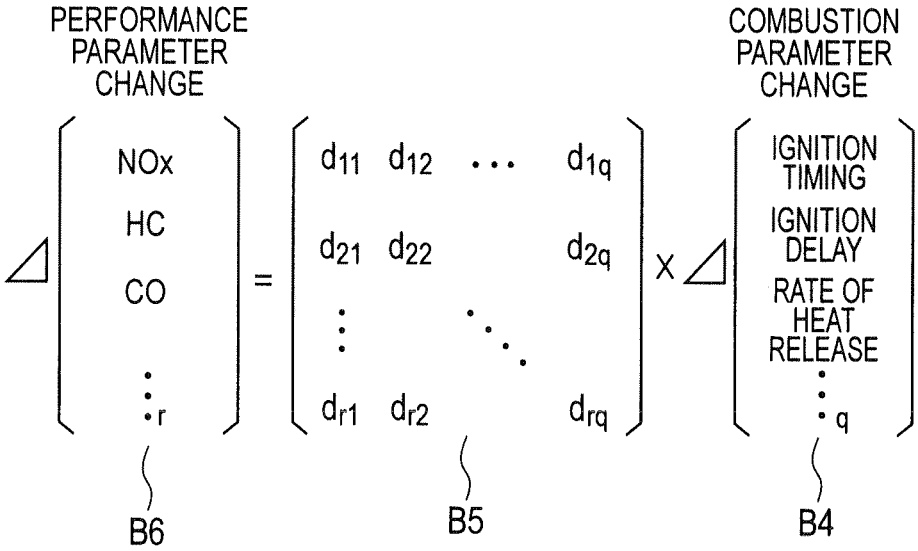

The combustion parameter range calculator 42 uses data on correlations between the combustion parameters and the controlled parameters to calculate the variable ranges where current values of the combustion parameters are allowed to be changed, respectively. Specifically, the ROM of the ECU 20 stores a correlation arithmetic expression 42*a* (which will also be referred to as second correlation data) which defines correlations between the plurality of combustion parameters and the plurality of controlled parameters in the form of a forward mode. The correlation arithmetic expression 42*a* is defined by a determinant, as illustrated in FIG. 6(*a*). Specifically, the correlation arithmetic expression 42*b* is so designed that the product of a column vector B1 of variables representing changes in the controlled parameters and a matrix B2 made up of correlation coefficients $c_{11}$ to $c_{qp}$ is expressed as a column vector B3 of variables representing changes in the combustion parameters. The variable ranges of the controlled parameters, as derived by the controlled parameter range calculator 41, are substituted into the variables of the column vector B1 to derive solutions of the respective variables (i.e., entries) of the column vector B3 which represent the variable ranges of the respective combustion parameters.

The performance parameter change calculator 43 uses data on correlations between the performance parameters and the combustion parameters to calculate changes in value of the performance parameters which correspond to the variable ranges of the combustion parameters, as derived by the combustion parameter range calculator 42. Specifically, the ROM of the ECU 20 stores a correlation arithmetic expression 43*a* (which will also be referred to as first correlation data) which defines correlations between the plurality of performance parameters and the plurality of combustion parameters in the form of a forward mode. The correlation arithmetic expression 43*a* is defined by a determinant, as illustrated in FIG. 6(*b*). Specifically, the correlation arithmetic expression 42*b* is so designed that the product of a column vector B4 of variables representing changes in the combustion parameters and a matrix B5 made up of correlation coefficients $d_{11}$ to $d_{rq}$ is expressed as a column vector B6 of variables representing changes in the performance parameters. The variable ranges of the combustion parameters, as derived by the combustion parameter range calculator 42, are substituted into the variables of the column vector B4 to derive solutions of the respective variables (i.e., entries) of the column vector B6 which represent the changes in respective performance parameters.

The target fuel consumption calculator 44 uses the changes in the performance parameters, as derived by the performance parameter change calculator 43, to determine one of the changes, that is, the amount by which the fuel consumption is changed as a manipulative fuel consumption variable when the other changes in the performance parameters (i.e., the amounts of NOx, HC, and CO) lie in given permissible ranges. When the changes in the performance parameters (i.e., the amounts of NOx, HC, and CO) are out of the permissible ranges, the ECU 20 does not derive the manipulative fuel consumption variable, in other words, does not correct the target value of the fuel consumption.

Specifically, a combination of the performance parameter change calculator 43 and the target fuel consumption calculator 44 serves to figure out a change in amount of exhaust emissions from the engine 10 which will arise from the manipulation of the target fuel consumption and determines or fixes manipulative fuel consumption variable based on the calculated change.

The determination of whether the changes in amounts of NOx, HC, and CO are within the permissible ranges or not may be made by determining whether the sum of each of the amounts by which the amounts of NOx, HC, and CO are changed and a corresponding one of current amounts of NOx, HC, and CO meets the target value thereof or not.

The target updating circuit 45 works to subtract the manipulative fuel consumption variable, as derived by the target fuel consumption calculator 44, from the target fuel consumption, as calculated by the performance parameter calculator 31, to correct or update the target fuel consumption.

A deviation calculator 46 calculates a deviation of an actual value of consumption of fuel in the engine 10 from the target value, as corrected by the target updating circuit 45. The combustion parameter calculator 32 samples such a fuel consumption deviation in preference to the deviation, as derived by the performance parameter deviation calculator 34. The combustion parameter calculator 32 and the actuator controller 33 work to calculate the command values for the controlled parameters in the manner as described above.

Figure 7:
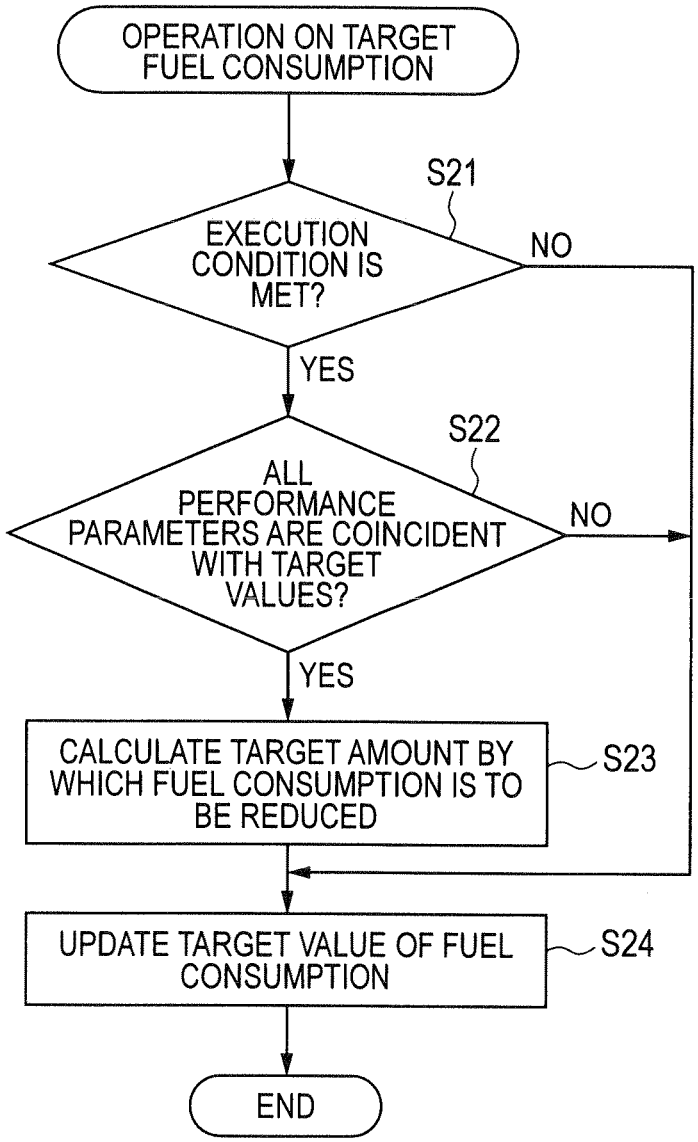
FIG. 7 is a flowchart of a target fuel consumption control program to be executed by the engine control system of FIG. 1(*a*)

FIG. 7 is a flowchart of a sequence of logical steps or target fuel consumption control program to be executed by the ECU 20 at a regular interval (e.g., an operation cycle of the CPU or a cycle equivalent to a given crank angle of the engine 10). This program is performed between steps S12 and S13 of the control command calculation program of FIG. 2, that is, after the actual values of the performance parameters are acquired and before the deviations of the performance parameters are calculated.

After entering the program, the routine proceeds to step S21 wherein it is determined whether an execution condition where the target fuel consumption is allowed to be manipulated or corrected is met or not. For instance, when the engine 10 is running in the steady state or in an economy mode, the execution condition is determined to be met. The engine control system is engineered to run the engine 10 in a selected one of a normal mode, a sport mode, and an economy mode which are different in specific consumption of fuel from each other. The economy mode is the lowest in fuel consumption. When the engine 10 is running in the idle mode, the execution condition may also be determined to be satisfied.

If a YES answer is obtained in step S21, then the routine proceeds to step S22 wherein it is determined whether all the performance parameters has reached the target values thereof or not. If a NO answer is obtained either in step S21 or step S22, the routine terminates. In other words, the routine proceeds to step S13 of FIG. 2 without correcting the target fuel consumption. Alternatively, if a YES answer is obtained in step S22, then the routine proceeds to step S23.

In step S23, the manipulative fuel consumption variable that is the amount by which the consumption of fuel in the engine 10 is to be reduced is determined. Specifically, the controlled parameter range calculator 41, as already described in FIG. 5, calculates the variable ranges where current values of the controlled parameters are allowed to be changed, respectively. The combustion parameter range calculator 42 uses the correlation arithmetic expression 42*a* to determine the variable range where each of current values of the combustion parameters is allowed to be changed based on the variable ranges of the controlled parameters. The performance parameter change calculator 43 uses the correlation arithmetic expression 43*a* to determine the amount by which the value of each of the performance parameters is changed in correspondence with the variable ranges of the combustion parameters. When the amounts by which the amounts of NOx, HC, and CO are changed lie within given permissible ranges, the target fuel consumption calculator 44 uses the changes in the performance parameters, as derived by the performance parameter change calculator 43, to determine the amount by which the fuel consumption is changed as the manipulative fuel consumption variable. When the changes in amount of NOx, HC, and CO are out of the permissible ranges, the ECU 20 does not derive the manipulative fuel consumption variable.

The routine then proceeds to step S24 wherein the target updating circuit 45 updates or corrects the target fuel consumption, as derived in step S11 of FIG. 2, using the target amount by which the fuel consumption is allowed to be changed, as derived in step S23.

After the target fuel consumption is corrected in the manner, as described above, the routine proceeds to step S13 of FIG. 2 wherein the deviation calculator 46 calculates a deviation (i.e., the performance parameter deviation) of the actual value of the fuel consumption from the corrected target fuel consumption. Subsequently, the ECU 20 then calculates the combustion parameters and the command values of the controlled parameters based on all the performance parameter deviations in the manner, as described above.

The correction of the target fuel consumption in the above manner will result in a decrease in consumption of fuel in the engine 10 without any deterioration of exhaust emissions from the engine 10 arising from the interference of the performance parameters with each other while each of the performance parameters (i.e., the fuel consumption and the amounts of exhaust emissions from the engine 10) is being regulated to coincide with the target value thereof in the feedback mode.

The engine control system of this embodiment offers the following advantages.

The engine control system works to use the combustion parameter arithmetic expression 32*b* (i.e., the first correlation data) which defines the correlations between the different types of performance parameters and the different types of combustion parameters to determine the target values of the combustion parameters as a function of the target values of the performance parameters, respectively. The engine control system also uses the controlled parameter arithmetic expression 33*b* (i.e., the second correlation data) which defines the correlations between the different types of combustion parameters and the different types of controlled parameters to determine the command values (i.e., target values) of the controlled parameters as a function of the target values of the combustion parameters.

The combustion parameter arithmetic expression 32*b* is, as described above, designed to define the correlations between the plurality of performance parameters and the plurality of combustion parameters. Similarly, the controlled parameter arithmetic expression 33*b* is designed to define the correlations between the plurality of combustion parameters and the plurality of controlled parameters. Therefore, unlike the prior art system which separately calculates target values of parameters corresponding to the performance parameters and the controlled parameters, the engine control system of this embodiment works to establish the harmonization of the performance parameters and the controlled parameters without any interference therebetween, thus ensuring the stability in controlling the engine 10, that is, improvement in bringing the performance parameters and the controlled parameters closer to the target values thereof simultaneously.

The engine control system also works to select the fuel consumption as a target to be optimized further when the actual value of each of all the performance parameters is controlled to coincide with the target value, as calculated as a function of instantaneous operating conditions of the engine 10 and correct or improve the target value of the fuel consumption based on the amount of exhaust emissions (i.e., NOx, HC, and CO). The use of the first correlation data enables how each of the combustion parameters changes to be figured out when one of the performance parameters (i.e., the fuel consumption in this embodiment) is changed and how the other performance parameters which are not to be corrected change with changes in the combustion parameters to be also found. The engine control system, therefore, serves to optimize the fuel consumption that is one of the performance parameters while recognizing how the other performance parameters change. The combustion states of the engine 10 (i.e., the combustion parameters) bear the correlations to the controlled parameters for the actuators 11, thus enabling the engine control system to know how the performance parameters change and control the operations of the actuators 11 desirably. This improves the control of the performance of the engine 10 without any interference of the performance parameters contributing the deterioration of control of the engine 10.

The engine control system also works to calculate a change in amount of exhaust emissions from the engine 10 which will result from a change in the target value of the fuel consumption and correct or fix the target value based on the calculated change. Specifically, the engine control system uses the correlation arithmetic expression 43*a* (i.e., the first correlation data) to calculate the changes in performance parameters which correspond to the variable ranges of the combustion parameters and determines, as the manipulative fuel consumption variable, the change in fuel consumption using the changes in the performance parameters when the changes in amount of exhaust emissions from the engine 10 lie in the permissible ranges.

The use of the correlation arithmetic expression 43*a* facilitates the ease of calculating the changes in the plurality of performance parameters which correspond to the variable ranges of the combustion parameters. The changes in the performance parameters may be different from each other. However, the change in fuel consumption (i.e., the solution of the correlation arithmetic expression 43*a*) is set to the amount by which the target value of the fuel consumption is allowed to be changed (i.e., the manipulative fuel consumption variable) only when the changes in amount of exhaust emissions lie within the permissible ranges, thus ensuring the stability in bringing the actual values of the other performance parameters into agreement with the target values even when the target value of the fuel consumption is corrected.

The variable ranges of the combustion parameters for use in calculating the changes in the performance parameters through the correlation arithmetic expression 43*a* are derived based on the variable ranges of the controlled parameters using the correlation arithmetic expression 42*a* (i.e., the second correlation data) defining the correlations between the combustion parameters and the controlled parameters. The use of the correlation arithmetic expression 42*a* defining the correlations between the combustion parameters and the controlled parameters facilitates ease of calculating the variable ranges of the combustion parameters as a function of the variable ranges of the controlled parameters. The variable ranges of the combustion parameters are derived simultaneously, thus resulting in improved efficiency in determining the variable ranges of the combustion parameters for operating or correcting the target value of the performance parameter.

The engine control system of this embodiment is designed to select the fuel consumption in the engine 10 that is one of the performance parameters as a target to be corrected and also select the amounts of exhaust emissions from the engine 10 that are the other performance parameters as non-targets not to be corrected and works to correct the target value of the fuel consumption so as to enhance the level of the selected one of the performance parameters, that is, to improve the fuel efficiency in the engine 10 based on the amounts of exhaust emissions from the engine 10. This optimizes the consumption of fuel in the engine 10 in real time without deteriorating the exhaust emissions such as NOx, CO, and HC.

The engine control system works to bring the actual values of the performance parameters into agreement with the target values thereof in the feedback mode and also bring the actual values of the combustion parameters into agreement with the target values thereof in the feedback mode. This ensures the stability in controlling the actual values of the performance and combustion parameters in the feedback mode even when the actual values change with a change in, for example, temperature of coolant for the engine 10, thus resulting in improved robustness against a change in environmental condition in controlling the engine 10.

The engine control system of the second embodiment will be described below.

In the engine control system of the first embodiment, the performance parameter change calculator 43, as illustrated in FIG. 5, uses the correlation arithmetic expression 43*a* to determine the changes in performance parameters. When the changes in amount of NOx, HC, and CO, as calculated by the performance parameter change calculator 43, lie in the permissible ranges, respectively, the target fuel consumption calculator 44 determines the change in fuel consumption, as derived by the performance parameter change calculator 43, as the manipulative fuel consumption variable. The engine control system of the second embodiment is designed to determine the amount by which the target value of the fuel consumption is allowed to be corrected (i.e., the manipulative fuel consumption variable, as derived using the correlation arithmetic expression 43*a*) as a maximum manipulative variable (i.e., a guard value) and changes the target value of the fuel consumption gradually or stepwise so as to improve the fuel efficiency until such a change in the target value reaches the maximum manipulative variable. After start of decreasing the target value of the fuel consumption, the engine control system decides whether the amount by which a selected one of the combustion parameters will be changed is greater than or equal to a given value or not. If so, the engine control system stops correcting the target value of the fuel consumption further.

Figure 8:
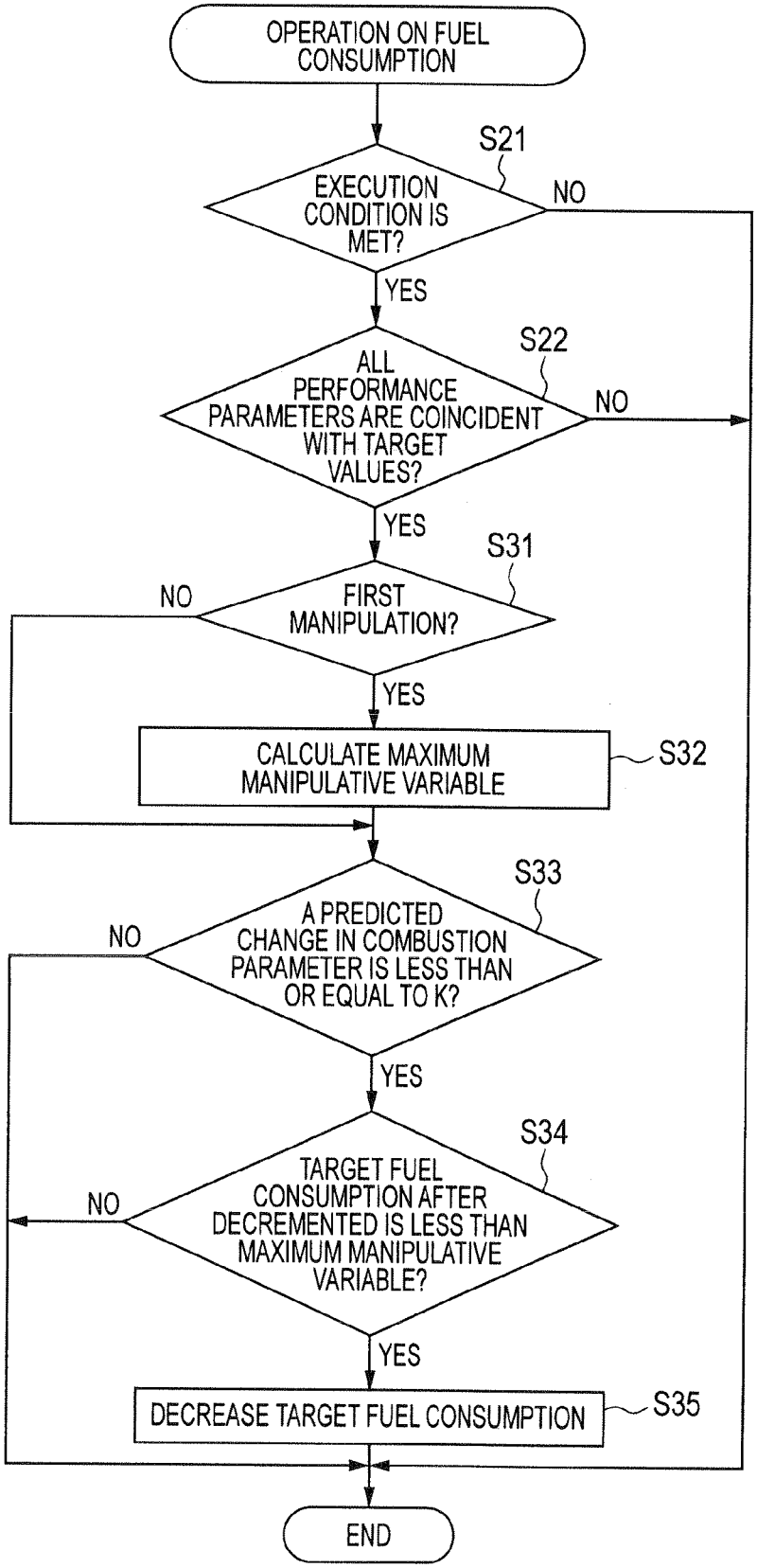
FIG. 8 is a flowchart of a target fuel consumption control program to be executed by an engine control system of the second embodiment.

FIG. 8 is a flowchart of a sequence of logical steps or target fuel consumption control program to be executed by the ECU 20 installed in the engine control system of the second embodiment at a regular interval (e.g., an operation cycle of the CPU or a cycle equivalent to a given crank angle of the engine 10). The same step numbers, as employed in FIG. 7, refer to the same operations.

After entering the program, the routine proceeds to step S21 wherein it is determined whether an execution condition where the target fuel consumption is allowed to be corrected is met or not in the same manner, as described in FIG. 7.

If a YES answer is obtained in step S21, then the routine proceeds to step S22 wherein it is determined whether all the performance parameters have reached or are in coincidence with the target values thereof or not.

If a YES answer is obtained in step S22, then the routine proceeds to step S31 wherein it is determined whether a first one of a sequence of multiple steps of correcting the target value of the fuel consumption is to be initiated or not. If YES answers have been obtained in steps S21 and S22 for the first time after start of this program, a YES answer is obtained in step S31.

The routine then proceeds to step S32 wherein like in step S23 of FIG. 7, the correlation arithmetic expression 42*a* which defines the correlations between the combustion parameters and the controlled parameters is used to determine the variable ranges where current values of the combustion parameters are allowed to be changed, respectively. Similarly, the correlation arithmetic expression 43*a* which defines the correlations between the performance parameters and the combustion parameters is used to determine the amount by which the value of each of the performance parameters is changed. The amount by which the fuel consumption that is one of the performance parameters is allowed to be decreased (i.e., the manipulative fuel consumption variable) is then determined as the maximum manipulative variable.

After step S32, the routine proceeds to step S33. If a NO answer is obtained in step S31 meaning that a second or following one of the multiple steps of decreasing the target value of the fuel consumption has already been initiated, then the routine proceeds directly to step S33.

In step S33, it is determined whether a change in a selected one of the combustion parameters which is predicated to arise from a decrement a of the target fuel consumption from the current value thereof is less than or equal to a given value K or not. The decrement a is the amount by which the target fuel consumption is to be decreased in each of the multiple steps. For instance, a correlation between the performance parameter (i.e., the fuel consumption) and the combustion parameter(s) may be prepared using an inverse model of the above correlation data to determine the change in the one of the combustion parameters.

The determination in step S33 may alternatively be made as to whether changes in selected some or all of the combustion parameters which are predicted to arise from the decrement a of the target fuel consumption are less than or equal to given respective values K or not or whether the greatest one of the changes in all of the combustion parameters is less than or equal to a given value K or not. In this embodiment, one of the combustion parameters (e.g., the amount of fuel going through combustion) which is the strongest in correlation to the consumption of fuel in the engine 10 is predetermined. A predicted change in such a combustion parameter is used in the determination in step S33.

If a YES answer is obtained in step S33, then the routine proceeds to step S34 wherein it is determined whether the target fuel consumption predicted to be derived after changed by the decrement a is less than the initial value of the target fuel consumption minus the maximum manipulative variable, as calculated in step S32, or not.

If a NO answer is obtained in either of step S33 or step S34, then the routine terminates. Alternatively, if a YES answer is obtained in step S34, then the routine proceeds to step 35, the target fuel consumption is decreased by the decrement a.

The engine control system of this embodiment works to prepare the maximum manipulative variable before the target fuel consumption is corrected and then decrement the target fuel consumption stepwise until a total amount by which the target fuel consumption has been changed reaches the maximum manipulative variable. When a change in the one of the combustion parameters which is predicated to arise from the decrement a of the target fuel consumption from the current value thereof is not less than or equal to the given value K (i.e., a NO answer is obtained in step S33), the ECU 20 stops decreasing the target fuel consumption further. Additionally, when either one or some of the performance parameters deviate from the target values thereof (i.e., a NO answer is obtained in step S22), the ECU 20 stops decreasing or correcting the target fuel consumption.

As apparent from the above discussion, the engine control system serves to decrease the consumption of fuel in the engine 10 gradually within the maximum manipulative variable, thus avoiding a rapid change in state of combustion of fuel in the engine 10. The maximum manipulative variable is the amount by which the target fuel consumption is allowed to be changed and which is calculated based on the variable ranges of the combustion parameters and the first correlation data (especially, in the condition where changes in the performance parameters relating to exhaust emissions from the engine 10 lie within the permissible ranges), thus ensuring the stability of quality of the exhaust emissions.

The engine control system controls the decreasing of the target fuel consumption while monitoring whether such decreasing results in excessive changes in the combustion parameters or not, thus ensuring the stability in combustion of fuel in the engine 10.

The engine control system monitors a change in one of the combustion parameters which is the strongest in correlation to the consumption of the fuel in the engine 10, thus controlling the decreasing of the target fuel consumption with high sensitivity to the change in the one of the combustion parameters.

The engine control system of the third embodiment will be described below.

The engine control system of the first embodiment is, as described above, designed to substitute the deviations of the plurality of performance parameters into the combustion parameter arithmetic expression 32*b* (i.e., the first correlation data) to derive the changes in plurality of combustion parameters and also substitute the deviations of the plurality of combustion parameters into the controlled parameter arithmetic expression 33*b* (i.e., the second correlation data) to derive the changes in plurality of controlled parameters. The engine control system of the third embodiment is different from that of the first embodiment in such operations.

Figure 9:
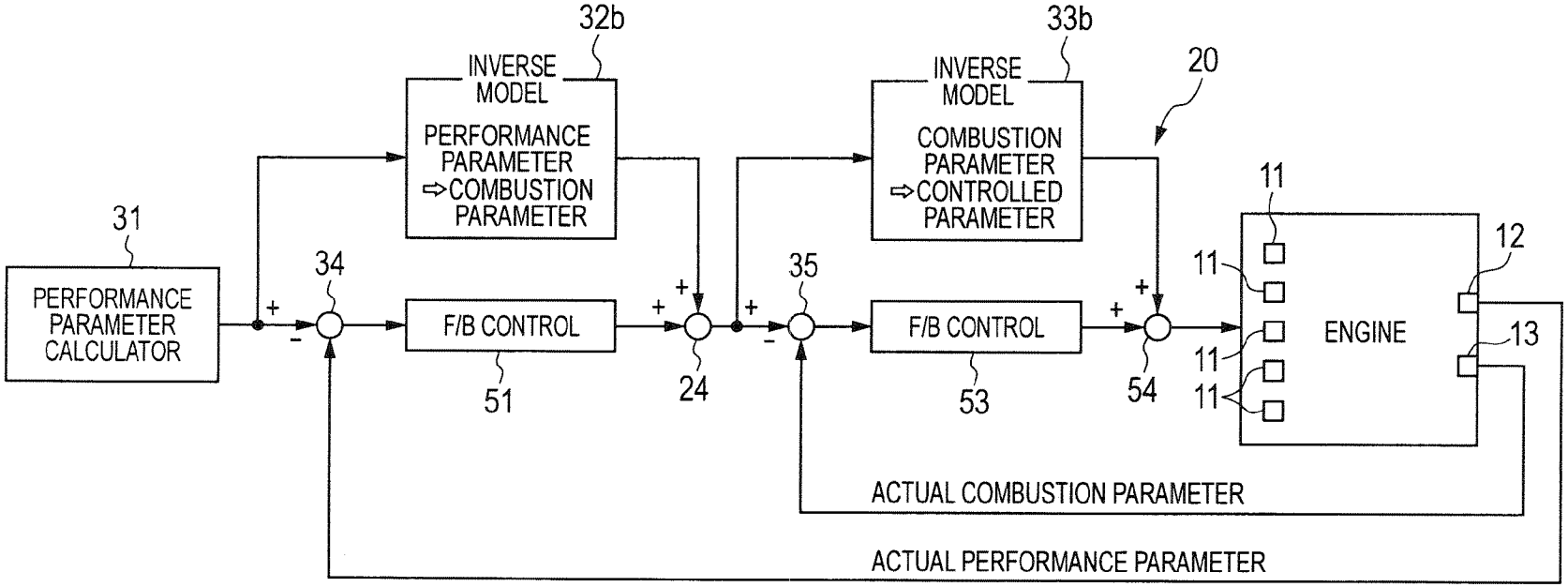
FIG. 9 is a block diagram which shows an engine control system according to the third embodiment.

Specifically, the engine control system of the third embodiment is, as illustrated in FIG. 9, is engineered to substitute the target values of the performance parameters into the combustion parameter arithmetic expression 32*b* (i.e., the first correlation data) to derive the target values of the combustion parameters and also substitute the target values of the combustion parameters into the controlled parameter arithmetic expression 33*b* (i.e., the second correlation data) to derive the command values (i.e., target values) of the controlled parameters.

The engine control system also includes feedback controllers 51 and 53 and correction circuits 52 and 54. The correction circuit 52 works to correct the targets of the performance parameters, as derived by the combustion parameter arithmetic expression 32*b*, using correction values, as calculated by the feedback controller 51. Similarly, the correction circuit 54 works to correct the command values of the controlled parameters, as derived by the controlled parameter arithmetic expression 33*b*, using correction values, as calculated by the feedback controller 53.

The engine control system of this embodiment serves to control the actual or calculated values of the combustion parameters and the performance parameters in the same coordinated feedback mode as in the first embodiment. The engine control system may be designed to have a combination of the structures of the first and second embodiments, that is, to improve the target value of the fuel consumption based on the amounts of exhaust emissions from the engine 10 such as NOx, HC, and CO in the condition where the actual value of each of the performance parameter matches the target value thereof, as calculated as a function of instantaneous operating conditions of the engine 10.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

The engine control system of each of the above embodiments, as described above, calculates the variable ranges of the combustion parameters using the correlation arithmetic expression 42*a* (i.e., the second correlation data) which defines the correlations between the combustion parameters and the controlled parameters and also calculates the amount by which the fuel consumption in the engine 10 is allowed to be decreased using the correlation arithmetic expression 43*a* (i.e., the first correlation data) which defines the correlations between the performance parameters and the combustion parameters, but may alternatively be engineered to determine the variable ranges of the combustion parameters as a function of instantaneous operating conditions of the engine 10.

The decrement by which the fuel consumption is allowed to be changed stepwise may be predetermined as a fixed value. The engine control system may change the target value of the fuel consumption by the fixed decrement. When a change in amount of exhaust emissions exceeds a permissible value, the engine control system stops changing the target value of the fuel consumption.

The engine control system of each of the above embodiment selects the fuel consumption in the engine 10 that is one of the performance parameters as a target to be corrected and also selects the amounts of exhaust emissions such as NOx, HC, and CO from the engine 10 that are the other performance parameters as non-targets not to be corrected and works to correct the target value of the fuel consumption so as to enhance the level of the fuel efficiency in the engine 10 based on the amounts of exhaust emissions from the engine 10, but conversely be engineered to select one or all of amounts of exhaust emissions such as NOx, HC, and CO from the engine 10 that are the other performance parameters as targets to be corrected and also select the fuel consumption in the engine 10 that is one of the performance parameters as a non-target not to be corrected and to correct the target value of, for example, the amount of NOx so as to improve the performance of the engine 10 based on an instantaneous value of the fuel consumption in the engine 10. The engine control system may also be designed to select the torque outputted by the engine 10 as a target to be corrected and also select the consumption and the combusted amount of fuel in the engine 10 as non-targets not to be corrected and to correct the target value of the torque so as to improve the performance of the engine 10 based on an instantaneous value of the consumption and/or the combusted amount of fuel in the engine 10. Another combination of the target(s) and non-target(s) may be selected.

The engine control system in each of the above embodiments controls the actual or calculated values of the combustion parameters and the performance parameters in the feedback mode, however, may alternatively be designed to control at least one of the former and the latter in the open-loop mode. For instance, the performance parameter deviation calculator 34, the feedback controller 51, and the correction circuit 52, as illustrated in FIG. 9, are omitted. The target values of the combustion parameters, as calculated through the combustion parameter arithmetic expression 32*b*, outputted directly to the actuator controller 33 without being adjusted in the feedback mode. Alternatively, the combustion parameter deviation calculator 35, the feedback controller 53, and the correction circuit 54 may be omitted. The target values of the controlled parameters, as calculated through the controlled parameter arithmetic expression 33*b*, are outputted directly to the actuators 11 without being adjusted in the feedback mode.

The engine control system uses the first correlation data (i.e., the combustion parameter arithmetic expression 32*b*) which defines the correlations between the different types of performance parameters and the different types of combustion parameters to calculate the target values of the combustion parameters and also uses the second correlation data (i.e., the controlled parameter arithmetic expression 33*b*) which defines the correlations between the different types of combustion parameters and the different types of controlled parameters to calculate the command values of the controlled parameters for controlling the operations of the actuators 11, etc., but may alternatively be designed to calculate the command values of the controlled parameters through an adaptability map without use of the second correlation data.

The ECU 20 may alternatively be engineered to store therein the first and second correlation data in a form different from the parameter arithmetic expressions (i.e., the determinants). For instance, the first and second correlation data may be expressed by maps. Specifically, the first correlation data is made by mapped constants representing a correlation of each of the combustion parameters to the plurality of controlled parameters. The second correlation data is made by mapped constants representing a correlation of each of the controlled parameters to the plurality of combustion parameters.

What is claimed is:

1. An engine control apparatus which controls operations of actuators to control combustion conditions in an engine, thereby controlling engine performances, comprising:

target performance setting means for setting a target value of each of a plurality of performance parameters representing said engine performances based on operating conditions of the engine;

target combustion setting means which uses first correlation data defining correlations between said plurality of performance parameters and a plurality of combustion parameters representing said combustion conditions to set target values of said plurality of combustion parameters based on the target values of the respective performance parameters, as set by said target performance setting means; and control command calculating means for calculating command values of controlled parameters associated with said actuators based on the target values of the respectively combustion parameters, as set by said target combustion setting means, and wherein said target performance setting means is equipped with target operating means which determines any of said plurality of performance parameters as an operated target in a condition where actual values of the performance parameters are controlled to the target values, as set by the target performance setting means, and operates the target value of the performance parameter, as determined as the operated target, to a performance enhancing side based on information about the performance parameters other than the operated target, and wherein said target operating means includes combustion parameter range calculating means which calculates operable ranges from current values of said plurality of combustion parameters when the target value of the performance parameter, as determined as the operated target, is operated, parameter change calculating means which uses the first correlation data to calculate changes in the plurality of performance parameters for the operable ranges based on the operable ranges, as calculated by said combustion parameter range calculating means, and target operating amount setting means which uses the changes in the plurality of performance parameters, as calculated by said parameter change calculating means, to set the change in the performance parameter that is the operated target as an operated amount of the target value thereof when the changes in the performance parameters other than the operated target are in given permissible ranges.

2. An engine control apparatus as set forth in claim 1, wherein said target operating means acquires changes in the performance parameters other than the operated target which have arisen from the operation on the target value of the operated target and operates the target value of the operated target based on the acquired changes.

3. An engine control apparatus as set forth in claim 1, wherein said target operating means determines the operated amount of the target value of the performance parameters, as set by said target operating amount setting means, as a maximum permissible operated amount and operates the target value of the performance parameter as the operated target to the performance enhancing side gradually.

4. An engine control apparatus as set forth in claim 3, further comprising a decision means for deciding whether changes in the combustion parameters after said target operating means starts to operate said target values are greater than or equal to a given value or not, and wherein when the decision means decides that the changes in the combustion parameters are greater than or equal to the given value, the target operating means stops operating the target values further.

5. An engine control apparatus as set forth in claim 4, wherein said decision means determines the change in one of the combustion parameters which is the strongest in correlation to the performance parameter, as selected as the operated target.

6. An engine control apparatus as set forth in claim 1, further comprising a controlled parameter range calculating means which calculates operable ranges from current values of said plurality of controlled parameters when the target value of the performance parameter, as selected as the operated target, is operated, and wherein said combustion parameter range calculating means uses second correlation data defining correlations between said plurality of combustion parameters and said plurality of controlled parameters to calculate the operable ranges of the combustion parameters based on the calculated operable ranges of the controlled parameters.

7. An engine control apparatus as set forth in claim 1, wherein said target operating means selects a specific fuel consumption in the engine as the operated target and also determines an amount of a specific component of exhaust emissions from the engine as the performance parameter that is not the operated target, and in that the target operating means operates the target value of the specific fuel consumption in the performance enhancing side based on the amount of the specific component.

8. An engine control apparatus as set forth in claim 1, wherein said control command calculating means uses second correlation data which defines correlations between said plurality of combustion parameters and said plurality of controlled parameters to determine the command values for the controlled parameters based on the target values of the combustion parameters, as set by the target combustion setting means.

* * * * *